US006057511A

United States Patent [19]

Ikeda et al.

[11] Patent Number: 6,057,511

[45] Date of Patent: May 2, 2000

[54] FLEXIBLE FLAT CABLE

[75] Inventors: Kenji Ikeda; Osamu Tamada; Yoshihiro Tamura, all of Yokkaichi, Japan

[73] Assignee: Sumitomo Wiring Systems, Ltd., Japan

[21] Appl. No.: 09/139,292

[22] Filed: Aug. 25, 1998

[30] Foreign Application Priority Data

Aug. 25, 1997 [JP] Japan ..... 9-228233

[51] Int. Cl.[7] ..... H01B 7/00

[52] U.S. Cl. ..... 174/110 R; 174/117 F; 174/110 AR

[58] Field of Search ..... 174/117 F, 117 FF, 174/117 A, 115, 117 AR

[56] References Cited

U.S. PATENT DOCUMENTS

| | | | |
|---|---|---|---|
| 3,458,650 | 7/1969 | Miyawaki et al. | 174/117 |
| 3,624,189 | 11/1971 | Goldman et al. | 264/25 |
| 4,381,208 | 4/1983 | Baverstock | 156/52 |
| 4,519,659 | 5/1985 | Shiino et al. | 339/59 |
| 5,281,762 | 1/1994 | Long et al. | 174/71 |
| 5,359,150 | 10/1994 | Ikeuchi | 174/117 F |

*Primary Examiner*—Kristine Kincaid
*Assistant Examiner*—William H Mayo, III
*Attorney, Agent, or Firm*—Jordan B. Bierman; Bierman, Muserlian and Lucas

[57] ABSTRACT

A flexible flat belt made up of a plurality of covered wires abutting each other in side-by-side relationship. Imaginary lines on the peripheries of the covered wires which are parallel to and remote from the axes of the wires determine at least one plane. The adjacent wires form troughs parallel to and spaced apart from the axes and adhesive is applied to the troughs between adjacent wires. It is preferred that a first adhesive, which sets instantaneously, be applied at spaced apart intervals between adjacent wires. Since this adhesive is spaced apart, flexibility is not impaired. This is used in conjunction with the second adhesive which is non-setting and is supplied substantially throughout the length of adjacent wires. Due to its character, it does not interfere with the flexibility of the flat cable. When wires of different diameters are used, they are either placed on a planar work surface and the adhesives applied between adjacent wires on the opposite side from the work surface or the work surface is provided with an offset so that the smaller diameter wires are placed on the offset surface and the larger diameter wires are placed on the surface portion. Since the offset equals the difference between the two diameters, the first set of imaginary lines forms the first plane, thus permitting easy application of the two adhesives.

17 Claims, 3 Drawing Sheets

FLEXIBLE FLAT CABLE

This Application claims the benefit of the priority of Japanese 9-228233, filed Aug. 25, 1997.

The present Invention is directed to a flexible flat cable formed from flexible covered wires grouped together. The invention also includes a method for making such cable.

BACKGROUND OF THE INVENTION

In the field of automation, there are many devices, such as processing machines, wherein a work piece is conveyed or moved in various directions. This requires cables to supply power and transmit control signals which are long enough and flexible so that displacement of the mechanism can be accomplished. It is generally required that a plurality of covered wires be provided for the traveling mechanism and it is not unusual to have in excess of three such cables joined together. In the past, if changes in design required additional cables, they could not be accommodated while, at the same time, maintaining the desired degree of freedom of motion.

Referring to FIGS. 7 and 8, when flexibility in the design of the device is desired, multiple individually covered wires 1 are grouped together and loosely passed through hollow cable cover 4 which is formed from a plurality of protective rings 2. Rings 2 are rotatably connected to one another by pins 3. Thus, cable cover 4 can flex freely, in the manner of caterpillar treads, within the available space in the device. As shown in FIG. 8, covered wires 1 are protected from external forces while remaining flexible.

The foregoing construction, however, possesses certain drawbacks. Repeated movements of the traveling mechanism can result in covered wires 1 crossing each other and/or becoming overlapped, as shown in FIG. 9. This is possible, even if covered wires 1 are loosely inserted in cable cover 4, with covered wires 1 in flat side-by-side arrangement. Thus, when such wires shift, they can end up lying on a path which is different from that origin ally intended. Therefore, if the path is longer than that initially designed, an excessive force can be applied to the wires and reduce their life span. In more extreme cases, they can even be broken.

In order to solve this problem, as shown in FIG. 10, positioning wall 7 has been inserted in each protective ring 2. Insertion openings 6 ar e formed thereon so that each individual covered wire 1 is permanently located therein. However, this arrangement does not permit the number of insertion openings 6 to be changed once cable cover 4 has been fabricated. Hence, desirable flexibility is lost and the presence of positioning walls 7 increases the cost of cable cover 4.

SUMMARY OF THE INVENTION

It is, therefore, an object of the present invention to provide a flexible cable, and a method for making it, wherein a plurality of covered wires can be grouped together in a flat arrangement and mounted flexibly on a flexible device. Moreover, a simple structure is provided which prevents the wires from crossing and/or overlapping.

In practicing the present invention, there is provided a plurality of covered wires abutting each other in side-by-side relationship with their longitudinal axes substantially parallel. This yields a flat cable having a first side and, opposite thereto, a second side. It is considered that there is a plurality of imaginary lines on the peripheries of the covered wires, which lines are parallel to and remote from the axes on at least one of the first and second sides. These imaginary lines determine a plane.

Adjacent wires, abutting each other, form a trough therebetween which extends in the direction parallel to and spaced apart from the axes. An adhesive is inserted into the troughs between the adjacent wires. Preferably, the adhesive is entirely within the trough and the depth of the adhesive is less than the distance between the bottom of the trough and the plane.

In a second embodiment of the invention, there is a first adhesive and a second adhesive. The first adhesive is applied, preferably in droplets, at intervals spaced apart along the trough and between the adjacent wires. A second adhesive is applied substantially continuously in the troughs. It is desirable that the first adhesive be instantaneous or rapid-setting and that the second adhesive be flexible, stretchable, and non-setting. As the first adhesive, a cyanoacrylate adhesive has been found useful. The second adhesive is advantageously based on butadiene-acrylonitrile and/or styrene-butadiene.

In a first embodiment of the invention, the covered wires making up the flat cable have substantially the same diameter. Therefore, when the wires are properly arranged, the imaginary lines on the first side determine a first plane and the imaginary lines on the second side determine a second plane. Alternatively, some of the covered wires have a first diameter and other covered wires have a second diameter, smaller than the first diameter. In this second embodiment, the imaginary lines determine only the first plane on the first side.

To produce the flat cable made up of wires of equal diameter, the wires are arranged in side-by-side abutting relationship on a flat support. Where adjacent wires abut one another, bonding lines are formed. The adhesive is applied along the bonding lines and preferably within the trough. In a particularly desirable form of the method, the first adhesive is applied at intervals spaced apart along the bonding lines and in the trough. Preferably, the first adhesive is applied in droplets so that the intervals between applications of the first adhesive are substantially greater than the lengths to which the first adhesive is applied. This is followed by application of the second adhesive in continuous fashion.

When the covered wires making up the flat cable are of different diameters, a work surface having an offset portion and a surface portion is provided. The offset portion differs in height from the surface portion by a distance substantially equal to the difference between the first (larger) diameters and the second (smaller) diameters. The former are placed on the surface portion and the latter on the offset portion. When this is done, the imaginary lines on the first side of the flat cable form the first plane. Thereafter, the adhesive is applied along the bonding lines and preferably within the troughs.

Here, too, a preferred form of the invention utilizes the first and second adhesives as described above. The first adhesive is applied at intervals spaced apart, preferably with the intervals being substantially longer than the droplets of first adhesive. Thereafter, the second adhesive is applied substantially continuously along the bonding lines. Both adhesives are desirably kept within the trough so that the depth of the adhesives is less than the distance between the bonding lines and the first plane.

BRIEF DESCRIPTION OF THE DRAWINGS

In the accompanying drawings, constituting a part hereof, and in which like reference characters indicate like parts.

DETAILED DESCRIPTION OF THE INVENTION

Figure 1:
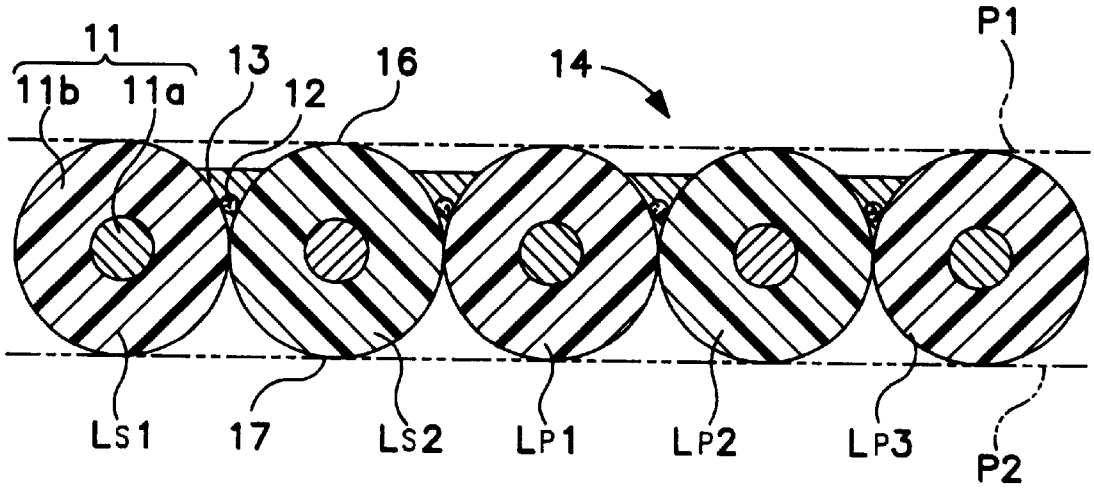
FIG. 1 is a cross-section of a flexible cable comprising wires of one diameter.
Figure 2:
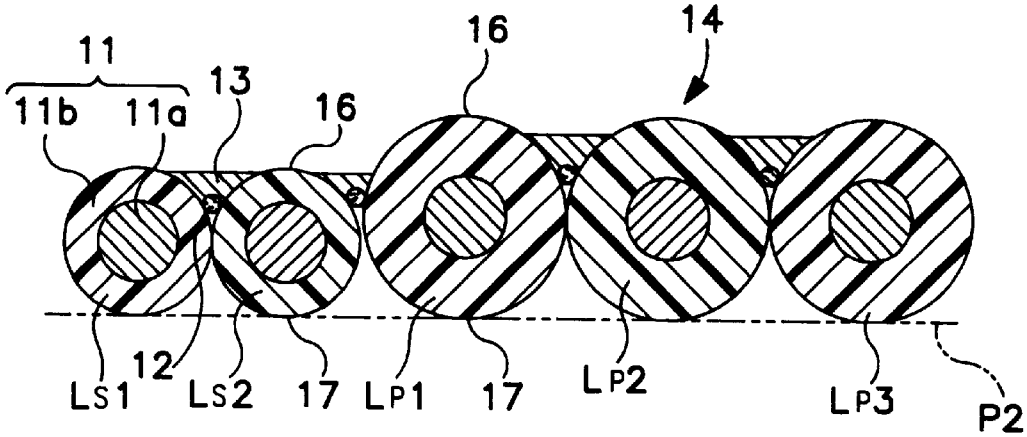
FIG. 2 is a view, similar to that of FIG. 1, showing a flexible flat cable comprising covered wires of two different diameters on a planar work surface.
Figure 3:
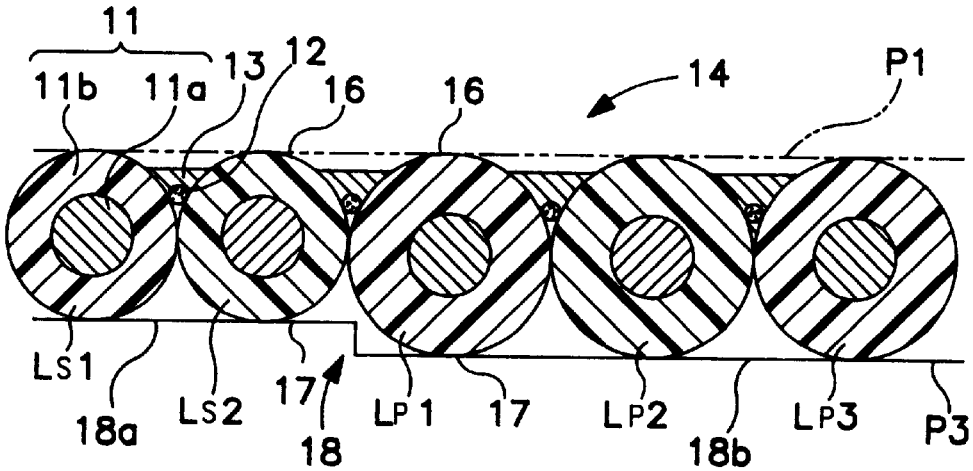
FIG. 3 is a view, similar to that of FIG. 2, wherein the smaller diameter covered wires are on the offset portion and the larger diameter wires are on the surface portion of the work surface.

Referring more specifically to FIGS. 1 to 3, flat cable 14 comprises covered wires 11 which, in turn, consist of cores 11*a* and protective layers 11*b*. They are placed side-by-side whereby imaginary lines 16 and 17 form first plane P1 and second plane P2. Covered wires 11 include control wires Ls1 and Ls2, as well as power supply wires Lp1, Lp2, and Lp3. First adhesive 12 is located in the trough formed by adjacent covered wires 11 and second adhesive 13 extends longitudinally along the trough.

In the second and third embodiments of the present invention, as shown in FIGS. 2 and 3, control wires Ls1 and Ls2 are of smaller diameter than power supply wires Lp1, Lp2, and Lp3. In the second embodiment (FIG. 2), second set of imaginary lines 17 define second plane P2 as flat cable 14 rests on a planar work surface (not shown).

In the third embodiment of the invention (see FIG. 3), work surface P3 comprises offset portion 18*a* and surface portion 18*b*. Offset 18 corresponds to the difference in diameter between the control wires and the power supply wires. Second set of imaginary lines 17 rest on offset portion 18*a* and surface portion 18*b* so that first set of imaginary lines 16 define first plane P1. First and second adhesives 12 and 13 are applied in the troughs between adjacent covered wires 11 with outer surface 15 thereof between first plane P1 and the abutment between adjacent wires.

Figure 4:
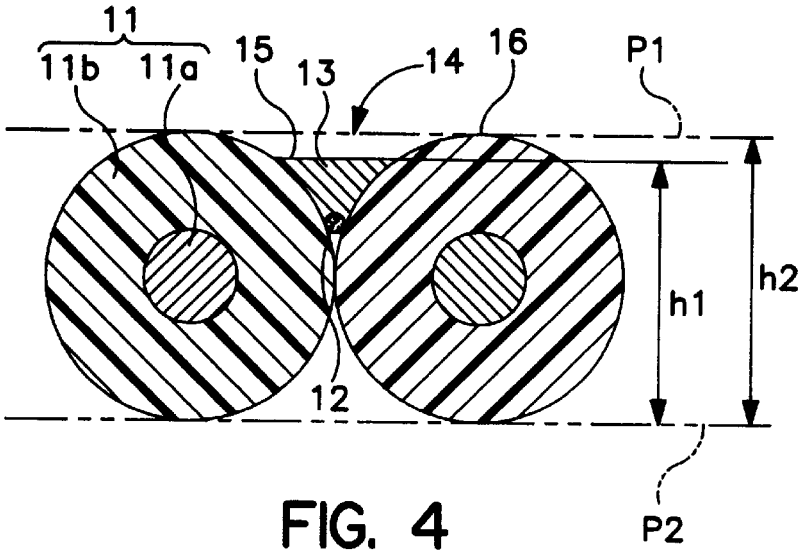
FIG. 4 is an enlarged view of a portion of FIG. 1.
Figure 5:
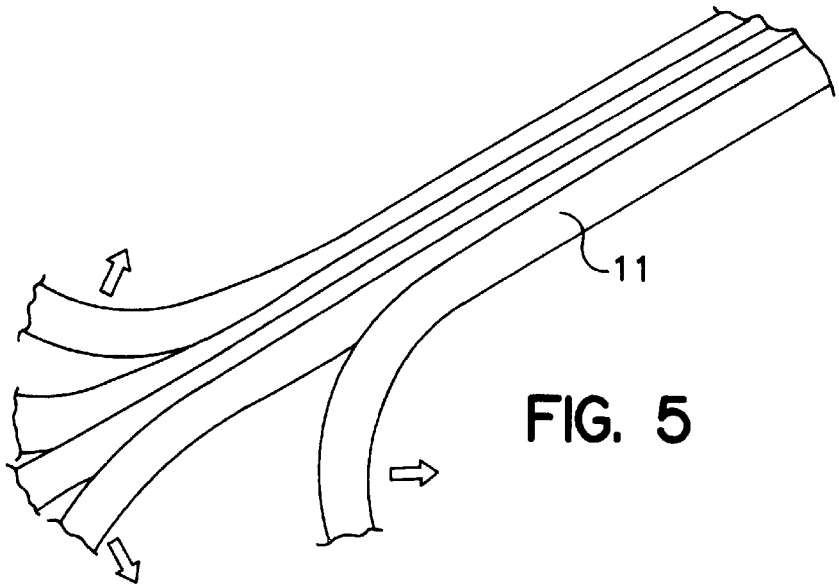
FIG. 5 is a perspective view of a flat cable with the ends of the covered wires separated for individual connection.
Figure 6:
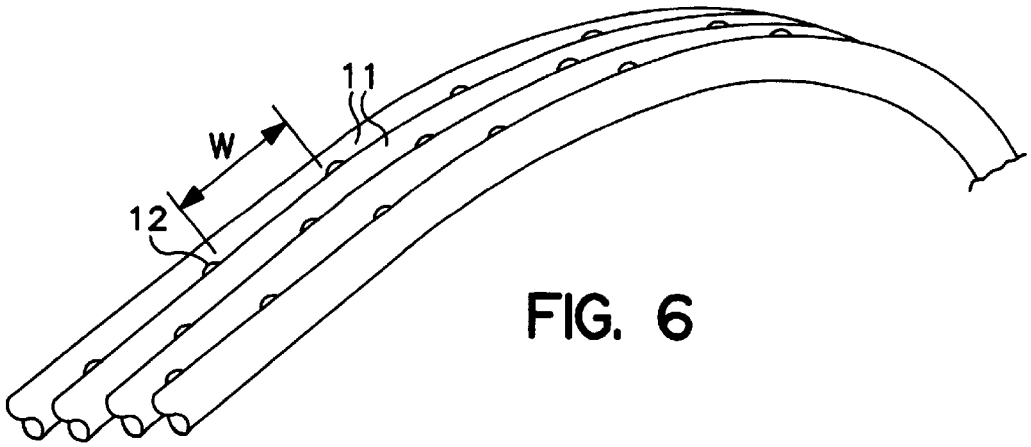
FIG. 6 is a perspective view showing the first adhesive applied.
Figure 7:
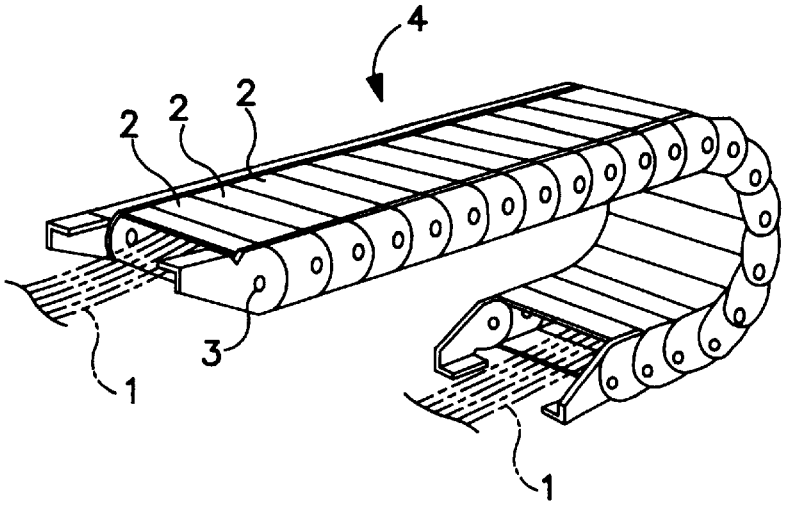
FIG. 7 (PRIOR ART)
FIG. 7 shows a prior art flexible cable cover protecting the covered wires.
Figure 8:
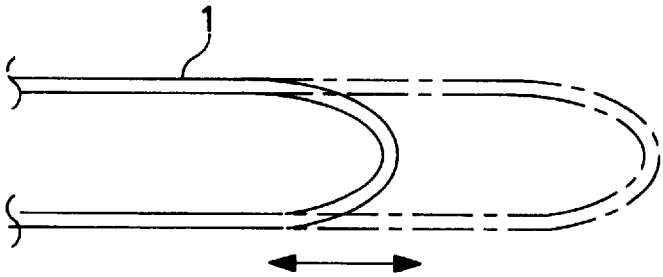
FIG. 8 (PRIOR ART)
FIG. 8 shows the prior art flexing of the flexible cable.
Figure 9:
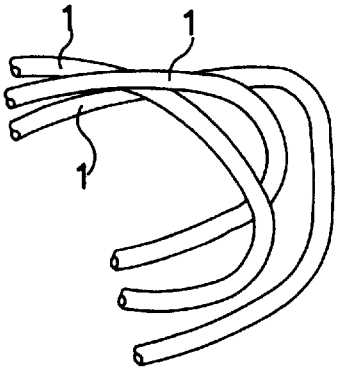
FIG. 9 (PRIOR ART)
FIG. 9 shows covered wires according to the prior art cross over and overlapping each other.
Figure 10:
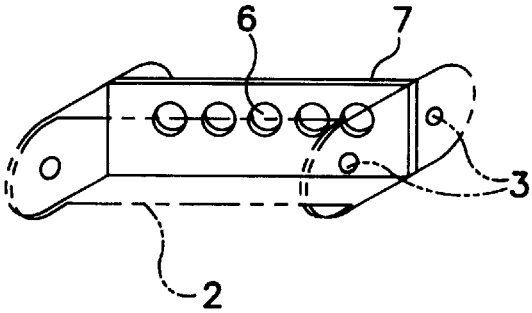
FIG. 10 (PRIOR ART)
FIG. 10 shows a prior art positioning wall within the cable cover.

Referring to FIG. 6, covered wires 11 are initially held by first adhesive 12 applied in droplets spaced apart by interval W. Since first adhesive 12 sets instantaneously, the flat cable is created without danger of any crossing over or overlapping. By spacing droplets of first adhesive 12 as shown, it is possible to separate the ends of covered wires 11 (as shown in FIG. 5), making it becomes easy to connect the ends of covered wires 11 to the various terminals to which they are directed. As can best be seen in FIG. 4, outer surface 15 of second adhesive 13 is below first plane P1 by a distance equal to the difference between height h2 and height h1.

In producing the first embodiment of cable 14, covered wires 11 are placed so that second set of imaginary lines 17 rests on a work surface (not shown) and defines second plane P2. In this embodiment, since all wires 11 are of the same diameter, first;set of imaginary lines 16 defines plane P1. Droplets of first adhesive 12 are then placed between adjacent covered wires 11 and spaced apart by intervals W as shown in FIG. 6. Since first adhesive 12 sets immediately, wires 11 are secured in their side-by-side relationship. Also, since the droplets of first adhesive 12 are spaced apart from each other, the flat cable retains its flexibility, even though first adhesive 12 is permanently set.

Next, second adhesive 13 is applied along the length of the trough. Since this is a non-setting adhesive, it does not impair flexibility, even though it aids in securing adjacent covered wires to one another. To facilitate connecting the ends of covered wires 11 to their intended terminals, the individual wires can be separated as shown in FIG. 6.

In producing the second embodiment of the present invention (see FIG. 2), second set of imaginary lines 17 is placed on the work surface (not shown). Since the latter is planar, second set of imaginary lines 17 define second plane P2. The remaining steps of the method are the same as those set forth in respect of the first embodiment of the invention.

The third embodiment of the invention is shown in FIG. 3. Work surface P3 is provided with offset surface 18*a* and surface portion 18*b*. Offset 18 substantially equals the difference in diameters between the control wires and the power supply wires. The control wires are placed on offset portion 18*a* and the power supply wires are placed on surface portion 18*b*. As a result, first set of imaginary lines form first plane P1. Thereafter, the remaining steps are the same as for the first embodiment.

Thus, it can be seen that the first adhesive is used for preliminary bonding, while the second adhesive is used for the primary bonding. Since the first adhesive is sufficient to retain the covered wires in their side-by-side position, application of the second adhesive can easily be carried out. By applying the first adhesive in substantially spaced droplets, the inherent flexibility of the cable is preserved. This is especially true if the amount of first adhesive applied is kept to a minimum.

As to the second adhesive, since it is non-setting, it holds the wires together, but does not impair their flexibility. Moreover, in accordance with the present invention, it is possible to separate the ends of the individual covered wires from one another to facilitate connection to the desired terminals.

While only a limited number of specific embodiments of the present invention have been expressly disclosed, it is, nonetheless, to be broadly construed, and not to be limited except by the character of the claimed appended hereto.

What we claim is:

1. A flexible flat cable comprising a plurality of covered wires abutting each other in a side-by-side relationship, said covered wires having longitudinal axes which are substantially parallel to each other, said flat cable having a first side and, opposite thereto, a second side, there being a plurality of imaginary lines on peripheries of said covered wires which are parallel to and remote from said axes on at least one of said first side and said second side, said imaginary lines determining at least a first plane, adjacent said covered wires forming troughs extending in a direction parallel to and spaced apart from said axes and being open toward said first side and said, second side of said cable respectively, a first adhesive and a second adhesive within at least one of said troughs.

2. The flexible flat cable of claim 1 wherein said first adhesive is a setting adhesive and said second adhesive is a flexible non-setting stretchable adhesive.

3. The flexible flat cable of claim 1 wherein said first adhesive is an instant-setting adhesive.

4. The flexible flat cable of claim 1 wherein said first adhesive is a cyanoacrylate adhesive and said second adhesive is selected from a group consisting of butadiene-acrylonitrile adhesives and styrene butadiene adhesives.

5. The flexible flat cable of claim 1 wherein said first adhesive is applied in droplets.

6. The flexible flat cable of claim 1 wherein said covered wires have substantially a same diameter, whereby a first set of said imaginary lines determines a first plane on said first side of said flat cable and a second set of said imaginary lines determines a second plane on said second side of said flat cable.

7. The flexible flat cable of claim 1 wherein some of said covered wires have a first diameter and others of said covered wires have a second diameter which is smaller than said first diameter, said imaginary lines determining a single said first plane on said first side.

8. A method of making the flexible flat cable of claim 7 comprising arranging said covered wires on a work surface having an offset portion and a surface portion, said offset portion differing in height from said surface portion by a distance substantially equal to a difference between said first diameter and said second diameter, said covered wires being positioned in a side-by-side abutting relationship, thereby forming bonding lines where adjacent said covered wires touch, said covered wires having said first diameter being on said surface portion and said covered wires having said second diameter being on said offset portion, whereby said imaginary lines determine said single plane on said first side, applying said first and second adhesives on said bonding lines and within said troughs.

9. The method of making the flexible flat cable of claim 8 wherein said first adhesive is applied in droplets.

10. The method of making the flexible flat cable of claim 8, comprising applying said first adhesive at intervals spaced apart along said bonding lines and in said troughs, applying said second adhesive substantially continuously along said bonding lines and in said troughs.

11. The flexible flat cable of claim 1 wherein some of said covered wires have a first diameter and others of said covered wires have a second diameter which is smaller than said first diameter, said imaginary lines determining a simple second plane on said second side.

12. A method of making the flexible flat cable of claim 1 comprising arranging said covered wires in side-by-side abutting relationship on a flat support, thereby forming bonding lines where adjacent said covered wires touch, applying said first and second adhesive on said bonding lines and within said troughs.

13. The method of claim 12, comprising:

applying said first adhesive at intervals spaced apart along said bonding lines and in said troughs, applying said second adhesive substantially continuously along said bonding lines and in said troughs.

14. The method of making the flexible flat cable of claim 13 wherein said first adhesive is applied in droplets.

15. The flexible flat cable of claim 1 wherein said first adhesive is spaced apart at intervals along said troughs between adjacent said covered wires, said second adhesive extends substantially continuously in said troughs.

16. A flexible flat cable comprising a plurality of covered wires abutting each other in a side-by-side relationship, said covered wires having longitudinal axes which are substantially parallel to each other, said flat cable having a first side and, opposite thereto, a second side, there being a plurality of imaginary lines on peripheries of said covered wires which are parallel to and remote from said axes on at least one of said first side and said second side, of said cable said imaginary lines determining at least a first plane, adjacent said covered wires forming troughs extending in a direction parallel to and spaced apart from said axes and being open toward said first side and said second side, of said cables respectively, at least one adhesive provided entirely within at least one of said troughs so that an entire depth of said adhesive is less than a distance between a bottom of said trough and at least said first plane.

17. A flexible flat cable comprising a plurality of covered wires abutting each other in a side-by-side relationship, said covered wires having longitudinal axes which are substantially parallel to each other, said flat cable having a first side and, opposite thereto, a second side, there being a plurality of imaginary lines on peripheries of said covered wires which are parallel to and remote from said axes on at least one of said first side and said second side, of said cable, said imaginary lines determining at least a first plane, adjacent said covered wires forming troughs extending in a direction parallel to and spaced apart from said axes and being open toward said first side and said second side, of said cable, respectively, a first adhesive and a second adhesive in at least one of said troughs, said first adhesive being a cyanoacrylate adhesive and said second adhesive being selected from a group consisting of butadieneacrylonitrile adhesives and styrene butadiene adhesives.

* * * * *